US009657934B2

(12) United States Patent
Xiong et al.

(10) Patent No.: US 9,657,934 B2
(45) Date of Patent: May 23, 2017

(54) LIGHTING DEVICE

(71) Applicant: PHILIPS LIGHTING HOLDING B.V., Eindhoven (NL)

(72) Inventors: Yan Xiong, Shanghai (CN); Qingqing Jiang, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/908,023

(22) PCT Filed: Aug. 14, 2014

(86) PCT No.: PCT/EP2014/067382
§ 371 (c)(1),
(2) Date: Jan. 27, 2016

(87) PCT Pub. No.: WO2015/024846
PCT Pub. Date: Feb. 26, 2015

(65) Prior Publication Data

US 2016/0186982 A1 Jun. 30, 2016

(30) Foreign Application Priority Data

Aug. 22, 2013 (WO) ..... PCT/CN2013/000977
Nov. 23, 2013 (EP) ..... 13194175

(51) Int. Cl.

| | |
|---|---|
| ***F21V 29/83*** | (2015.01) |
| ***F21V 29/506*** | (2015.01) |
| ***F21V 29/503*** | (2015.01) |
| ***F21V 29/508*** | (2015.01) |
| ***F21K 9/23*** | (2016.01) |
| *F21Y 101/00* | (2016.01) |

(52) U.S. Cl.
CPC ..... *F21V 29/83* (2015.01); *F21K 9/23* (2016.08); *F21V 29/503* (2015.01); *F21V 29/506* (2015.01); *F21V 29/508* (2015.01); *F21Y 2101/00* (2013.01)

(58) Field of Classification Search
CPC ..... F21V 29/83; F21V 29/503; F21V 29/506; F21V 29/508; F21K 9/23; F21Y 2101/00
See application file for complete search history.

(56) References Cited

U.S. PATENT DOCUMENTS

| | | | | |
|---|---|---|---|---|
| 8,388,197 | B1 | 3/2013 | Huang et al. | |
| 2009/0109625 | A1 | 4/2009 | Booth et al. | |
| 2011/0140587 | A1 | 6/2011 | Lee | |
| 2011/0176317 | A1* | 7/2011 | Bronowicz | F21V 25/12 362/373 |
| 2011/0193463 | A1 | 8/2011 | Daniel | |
| 2012/0230026 | A1 | 9/2012 | Li et al. | |

(Continued)

FOREIGN PATENT DOCUMENTS

| | | | |
|---|---|---|---|
| NO | WO2009103587 | A1 | 8/2009 |
| WO | 2013073792 | A1 | 5/2013 |

*Primary Examiner* — Mary Ellen Bowman

(57) ABSTRACT

A lighting device or a lamp bulb (100, 200) comprises at least one light source (101) and a driver assembly (108), said driver assembly comprising driver electronics; wherein during operation of the light source, a distance between an optical axis (120) of the lighting device and a heat flow of the lighting device is less than a distance between the optical axis (120) and a component of the driver electronics having the highest temperature sensitivity.

13 Claims, 7 Drawing Sheets

(56) References Cited

U.S. PATENT DOCUMENTS

| | | | | |
|---|---|---|---|---|
| 2013/0107550 | A1* | 5/2013 | Urano ..... | H01R 12/721<br>362/382 |
| 2013/0207542 | A1 | 8/2013 | Watanabe et al. | |

* cited by examiner

LIGHTING DEVICE

CROSS-REFERENCE TO PRIOR APPLICATIONS

This application is the U.S. National Phase application under 35 U.S.C. §371 of International Application No. PCT/EP2014/067382, filed on Aug. 14, 2014, which claims the benefit of European Patent Application No. 13194175.9, filed on Nov. 23, 2013 and of International Application No. PCT/CN2013/000977, filed on Aug. 22, 2013. These applications are hereby incorporated by reference herein.

FIELD OF THE INVENTION

The invention relates generally to a lighting device, and more specifically to a lighting device or a lamp bulb with a smooth outer appearance and improved thermal performance. The invention also relates to a luminaire with a lamp bulb having a smooth outer appearance and improved thermal performance.

BACKGROUND OF THE INVENTION

For an optimal thermal performance, a lighting device comprises a heat sink equipped with fins, for example back-reflecting lamp bulbs of type PAR, MR, BR, GU, etc. "PAR" means parabolic aluminized reflector. "MR" means multifaceted reflector. "BR" means bulged reflector, and "GU" refers to a U-shaped lamp with a plug-in lamp base. The light sources of the lamps include conventional halogen filaments or LED light sources.

Conventional heat sinks are made of die cast metal, such as aluminum, with high manufacturing and raw material costs. Further, for aesthetic reasons, a non-technical appearance without a visible cooling structure is desired. If the heat sink structure is hidden behind a smooth outer surface, airflow through the cooling structure is preferred for improved thermal performance, which requires inlet and outlet openings. For the desired look-and-feel, these openings should be small. However, a small channel has a high airflow resistance, reducing the cooling performance of the heat sink structure. Since the cooling performance is mainly determined by the amount of air that flows through the cooling structure, also referred to as internal channel, this will reduce the cooling performance of the heat sink.

US2012/0044680A1 discloses an illustrator with LED including a rear housing having a cavity. A front housing is disposed in the cavity, wherein the front housing includes through holes. An illuminating module is sandwiched between the rear housing and the front housing. Air holes are formed on the sidewall of the rear housing, so that the cavity can communicate with outside air.

An example of a retrofit lamp with a smooth outer appearance may be found in the patent application PCT/IB2013/052999 "Lighting Device with Smooth Outer Appearance", incorporated herein by reference. As shown in FIG. 1, the retrofit lamp 100' comprises at least one light source 101'; a heat sink component 104', having a bottom 1043' and a sidewall 1044' extending from the bottom 1043', wherein the bottom 1043' comprises a concave part 1041' and wherein the at least one light source 101' thermally contacts the concave part 1041' of the heat sink component 104'; and a cover 103' provided on the sidewall 1044' opposite to the bottom 1043', thereby defining an air chamber 1051' between the cover 103', the sidewall 1044', the bottom 1043' and the concave part 1041'. The heat sink component 104' comprises a cover opening 102' and a heat sink opening 106'. The air chamber 1051' forms a channel between the cover opening and the heat sink opening to allow a flow of air 105' between the cover opening and the heat sink opening or vice versa. A housing 107' is provided between the heat sink component 104' and the base 109'. A driver assembly 108' is provided between the housing 107' and the concave part 1041'. When the lamp 100' is mounted in a vertical operating position as shown in FIG. 2, the air surrounding the lamp warms up during lamp operation, and the warm air will rise because of natural convection.

While the thermal rating, i.e. the maximum temperature for which they are rated to operate without being negatively affected, of most of the components of both the driver assembly and the light source is above 125° C., some of them, such as the electrolytic capacitor(s), are more sensitive to high temperatures. However, the construction of the previous types of lamps results in an unsuitable arrangement, as the thermally sensitive components on the driver assembly 108' are heated by the rising warm air.

It is desired to combine optimal heat dissipation with the advantages of a smooth outer appearance of the lighting device.

SUMMARY OF THE INVENTION

It is an object of the invention, among others, to achieve a lighting device with a smooth appearance, wherein the thermally sensitive electronic components are better protected against high temperatures.

To better address one or more of these concerns, in an aspect of the invention, an embodiment of a lighting device is presented which comprises: at least one light source and a driver assembly, said driver assembly comprising driver electronics. During operation of the light source, a distance between an optical axis of the lighting device and a heat flow of the lighting device is less than a distance between the optical axis and a component of the driver electronics having the highest temperature sensitivity.

The optical axis extends through the central portion of the lighting device. In the prior art lighting device, the driver assembly is mounted in the central portion. The temperature of the central portion is higher than that of the periphery of the lighting device due to poor heat dissipation in the central portion. In contrast thereto, according to the present invention, a heat flow is provided near the central portion with the warmed airflow during the operation of the light source because of natural convection. According to the invention, the component of the driver electronics having the highest temperature sensitivity is provided at a distance from the central portion. As a result, a light device according to the present invention is advantageous in at least the following two aspects:

- The airflow near the optical axis improves the heat dissipation of the central portion of the lighting device;
- The thermally sensitive driver electronics is minimally influenced by the heat flow.

In an embodiment, the lighting device further comprises: a heat sink component having a bottom, a sidewall extending from the bottom, and a concave part extending from the bottom into the heat sink component, and wherein the at least one light source thermally contacts the concave part; wherein the heat sink component comprises a heat sink opening, and the heat sink opening comprises a plurality of holes in the bottom of the heat sink component between the concave part and the sidewall; and a cover provided on the sidewall and opposite to the bottom, thereby defining an air chamber between the cover, the sidewall, the bottom and the concave part; wherein the cover comprises a cover opening, and the air chamber forms a channel between the cover opening and the heat sink opening to allow a flow of air between the cover opening and the heat sink opening or vice versa; wherein the driver assembly is arranged in the air chamber. This provides an unobtrusive, hardly visible opening in a side view of the lighting device in the form of a lamp bulb with an ornamental effect. A "chimney" effect may be built up within the channel between the cover opening and the heat sink opening, to achieve improved thermal dissipation. Preferably, a cross section of the channel is larger in surface area than at least one of the cover openings and the heat sink opening. By enlarging the cross section of the air chamber or channel between the inlet and the outlet, which are the cover opening and the heat sink opening, so that the air velocity inside the air chamber or channel is as low as possible, flow losses in the system are minimized.

Preferably, in an embodiment, the lighting device further comprises a housing having a plurality of first holes; wherein the concave part has a side surface and a top surface, and wherein the side surface of the concave part forms a portion of the air chamber; wherein a plurality of second holes is formed in the side surface to communicate with the first holes; and wherein a further channel is formed between the first holes and the second holes to allow a further flow of air between the first and the second holes, or vice versa, during operation of the light source, because of a "chimney" effect; the distance between an optical axis of the lighting device and the further flow of air is less than the distance between the optical axis and the driver assembly. The further airflow in the further channel communicates with the airflow in the channel between the cover opening and the heat sink opening at the location of the second holes in the side surface of the concave part. By virtue thereof, the further channel between the first holes and the second holes not only improves thermal dissipation of the central portion of the lighting device, but also provides for additional thermal dissipation to the channel between the cover opening and the heat sink opening.

In an embodiment, the driver assembly is arranged in a compartment within the air chamber. The driver assembly may be encased in the compartment by means of potting material to conduct heat from the driver electronics to the heat sink component. By encasing the driver electronics in potting material, the driver electronics will be able to conduct heat more efficiently to the heat sink component, thereby enabling the driver electronics to produce more power, or it may be manufactured from other, less costly materials, materials having a smaller environmental impact or materials producing more heat at the same power.

According to another embodiment of the invention, the potting material may advantageously be made from at least one of a group comprising silicon oil, micro silica powder and asphalt, or a mixture thereof, which are materials with a thermal conductivity which is advantageous for use as potting material.

In an embodiment, the cover comprises a rim at its outer periphery, and the cover opening comprises a plurality of holes in the rim.

In an embodiment, the cover is of a thermally conductive material which thermally contacts the sidewall of the heat sink component. Preferably, the cover comprises a recess which accommodates the at least one light source, and the recess thermally contacts the concave part. In this way, additional thermal contact between the at least one light source and the heat sink component is provided in a convenient and simple way. Preferably, the recess further comprises at least one optical element for the at least one light source. Preferably, the at least one optical element is selected from a group comprising a diffuser, a reflector, a lens, a collimator or a combination thereof.

In an embodiment, the sidewall has an intact, smooth, exposed surface. Alternatively, the sidewall may comprise a patch corresponding to a mounting position of the driver assembly.

In an embodiment, the at least one light source is thermally coupled to a PCB, which PCB extends into the air chamber; and which PCB has a plurality of PCB openings to allow a flow of air between the cover opening and the heat sink opening or vice versa. The PCB openings may be cut-outs at the edge of the PCB or holes in the PCB. Preferably, the PCB comprises a thermally conductive material, for example, a thick layer of copper, so that the thermal conductivity of the PCB is at least 28 W/mK, measured along the surface of the PCB.

This provides the PCB with good thermal conductivity, and therefore the PCB itself can act as a good heat sink. In other words, the airflow can dissipate the heat from the light source via the PCB. In one aspect, this leads to an increase of the thermal performance of the lighting device. In another aspect, this lowers the thermal requirements imposed on all other components in the lighting device, for example, the shell (referred to as heat sink component hereinabove) and the cover can be made of full plastic. It may not need glue, or grease, for the thermal coupling between components. As a full plastic lamp, it may no longer require painting, and there may be much fewer safety concerns for electric shock as compared to a metal housing. The assembly process of the lighting device may also be simplified. In this way, the total cost of the lighting device is substantially reduced.

In other embodiments of the lighting device, the at least one light source comprises a LED or an array of LEDs, and the lighting device can be a back-reflecting lamp bulb of type GU, MR, BR or PAR, such as GU10, MR16, BR30, BR40, R20, PAR38, PAR30L, PAR30S, PAR20, etc.

According to a second aspect of the invention, a luminaire is provided which comprises a lighting device or a lamp bulb according to the first aspect of the invention.

It is noted that the invention relates to all possible combinations of features recited in the claims.

BRIEF DESCRIPTION OF THE DRAWINGS

These and other aspects of the lighting device and the luminaire according to the invention will become apparent from and will be elucidated with respect to the implementations and embodiments described hereinafter and with reference to the accompanying drawings. In the drawings.

Figure 1:
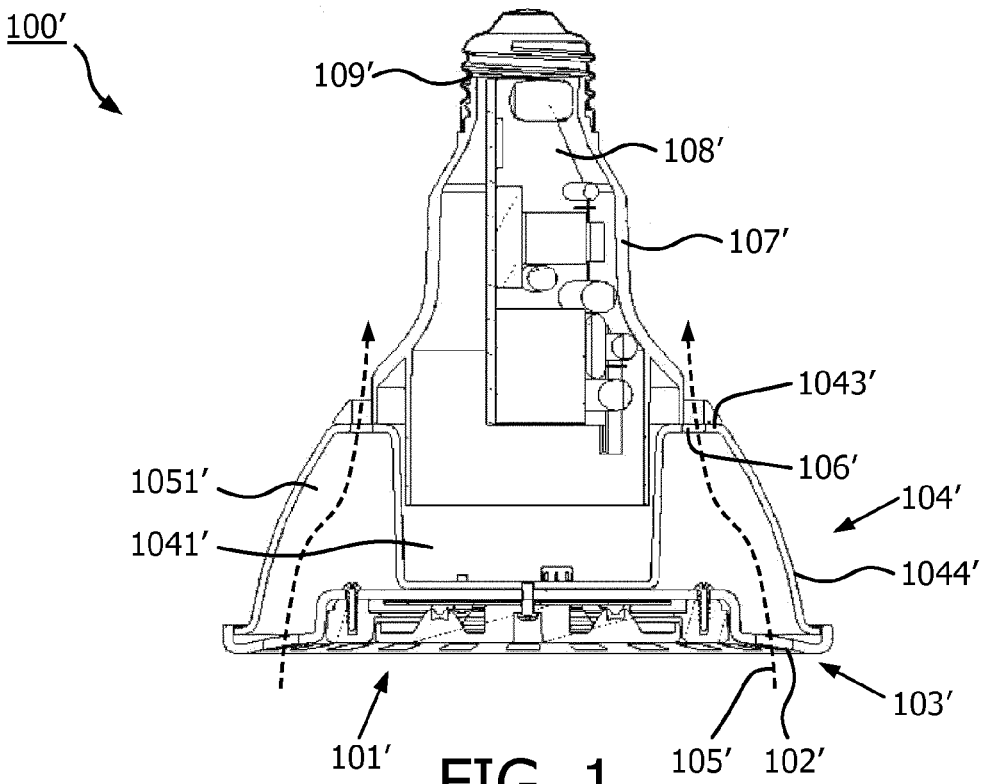
FIG. 1 shows an example of a retrofit lamp in the current applicant's unpublished patent application PCT/IB2013/052999.
Figure 2:
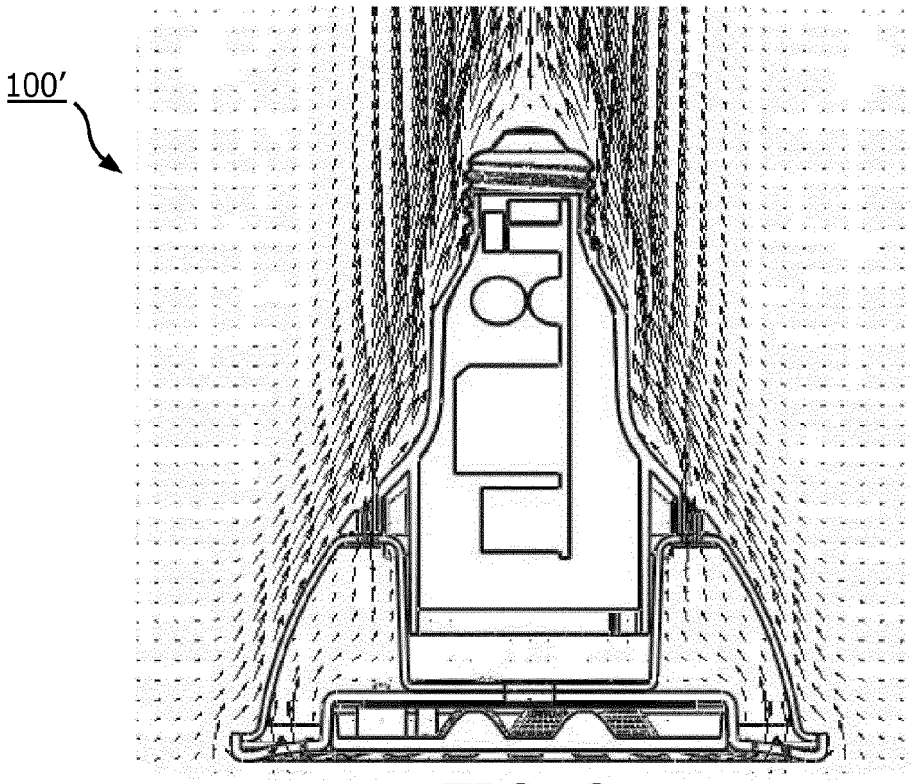
FIG. 2 illustrates the air velocity around and within the retrofit lamp of FIG. 1 during operation.

It should be noted that items denoted by the same reference numerals in different Figures have the same structural features and the same functions, or are the same signals. If the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

Figure 3:
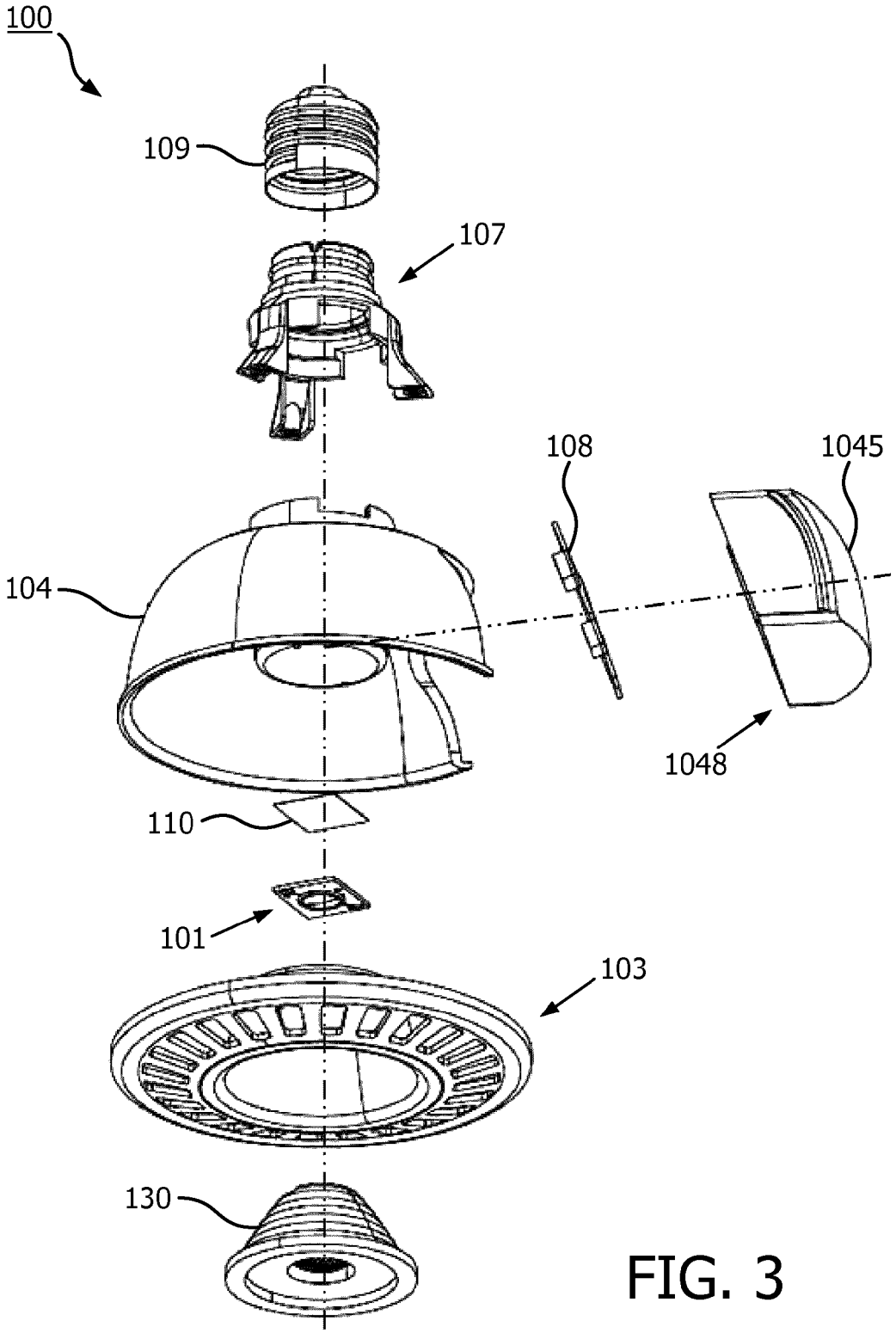
FIG. 3 shows an exploded view of a lighting device according to an embodiment of the invention.
Figure 4:
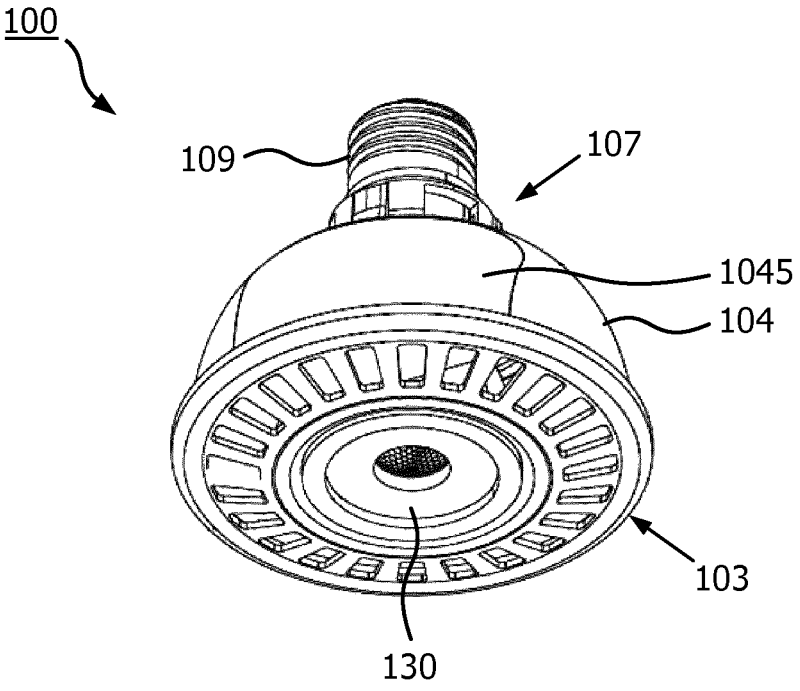
FIG. 4 shows a perspective side view of the lighting device illustrated in FIG. 3.

An embodiment of the lighting device according to the present inventive concept is illustrated in FIG. 3, and different views of the lighting device are presented in FIGS. 4 to 8. FIG. 3 illustrates a PAR type lamp 100 with LEDs or a LED array representing a light source 101 mounted in the front end opposite to the base 109. The light source 101 is mounted on a PCB 110 which is thermally coupled to a cover 103 and a heat sink component 104. There are openings 102 in the cover 103, and openings 106 in the heat sink component 104. The cover 103 may act as an additional heat sink component and is thermally coupled to the heat sink component 104 at least along its outer periphery.

Figure 6:
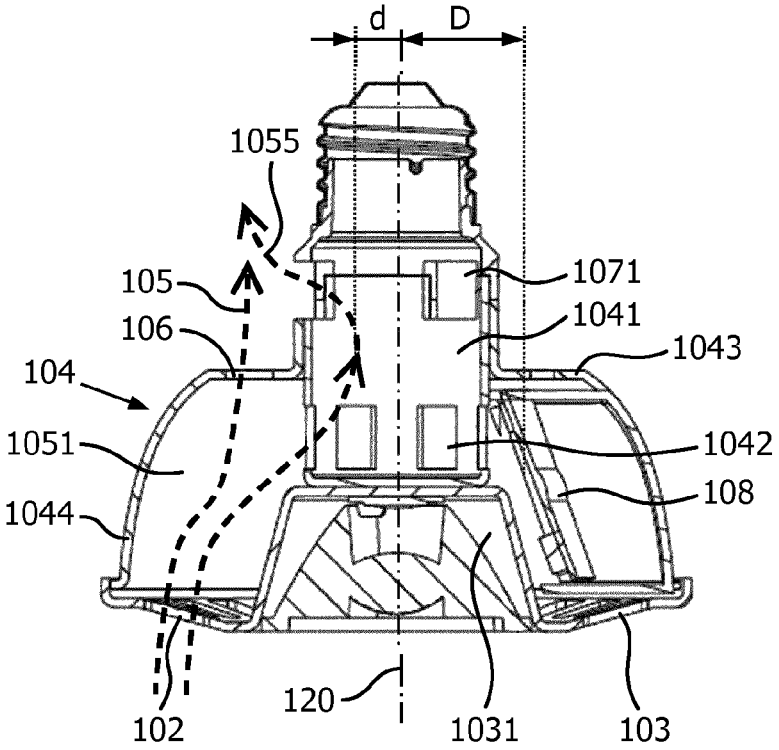
FIG. 6 shows a cross sectional view of the lighting device illustrated in FIG. 3 during operation, taken on the line A-A of FIG. 5.
Figure 7:
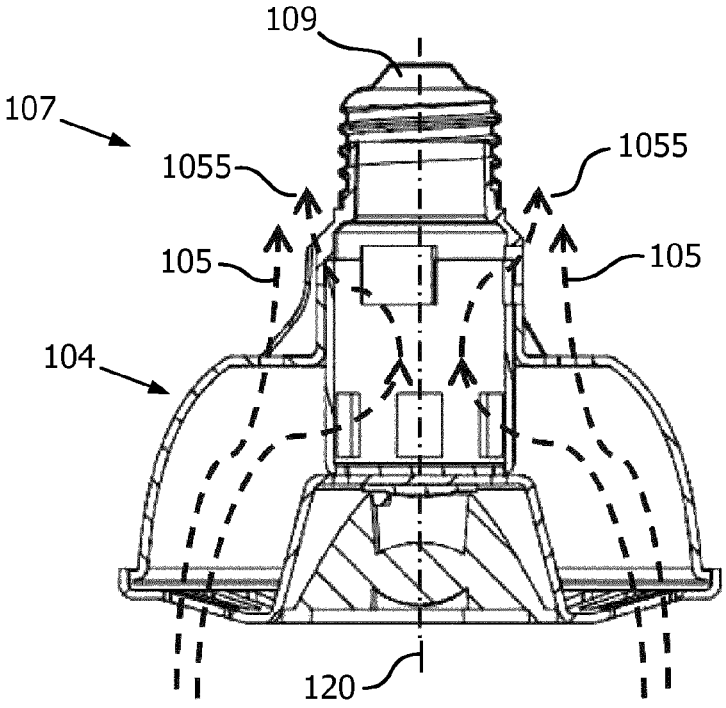
FIG. 7 shows a cross sectional view of the lighting device illustrated in FIG. 3 during operation, taken on the line B-B of FIG. 5.

As shown in FIG. 6, the cover 103 has a recess 1031 for accommodating the light source 101. Alternatively, the light source 101 is provided on the heat sink component 104, for example on the bottom part of the recess 1031, and the cover 103 comprises a light exit window where the light from the light source 101 can exit. In addition, suitable optics 130, for example, a diffuser, a reflector, a lens or a collimator, or a combination of these optical elements, can be included in the recess 1031 of the cover 103, thus providing a desired optical performance of the lamp 100.

The heat sink component 104 is, in this case, cup-shaped, and has a sidewall 1044 and a bottom 1043 with a concave part 1041 extending from the bottom 1043 into the heat sink component 104. A housing 107 is provided between the heat sink component 104 and the base 109. First holes 1071 are provided on the sidewall of housing 107, and second holes 1042 are provided on the side surface of the concave part 1041.

The cover 103 and the heat sink component 104 are, in this case, assembled so as to establish a good thermal connection at the bottom surface of the recess 1031 and the top surface of the concave part 1041, in addition to the thermal contact between the sidewall of the heat sink component 104 and the outer periphery of the cover 103. The heat generated by the light source 101 will, in this case, be conducted to the heat sink component 104 and the cover 103, in this case also acting as a heat sink, and will be dissipated relatively well at the exposed surfaces of the heat sink component 104 and the cover 103. The thermal connection between the recessed bottom and the top surface of the concave part can be established via direct attachment or via a thermally conductive medium, such as thermal glue or thermal filler. The thermal connection thickens the base of the heat sink and results in a better temperature distribution under the heat source.

Figure 5:
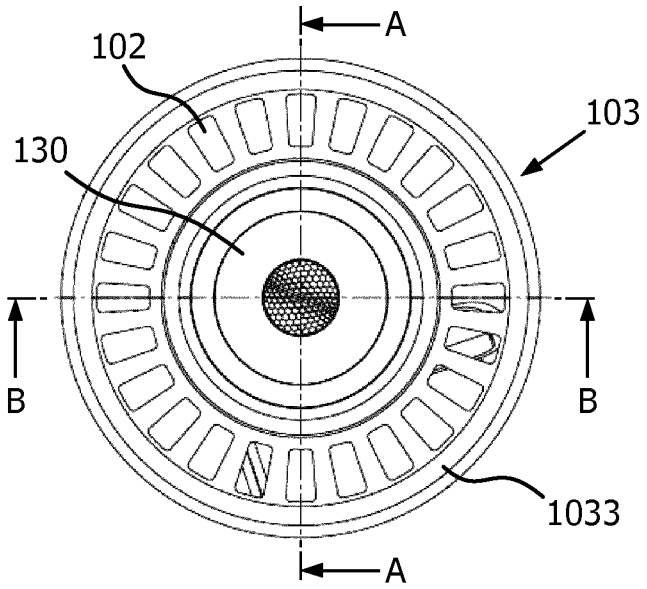
FIG. 5 shows a perspective bottom view of the lighting device illustrated in FIG. 3.
Figure 8:
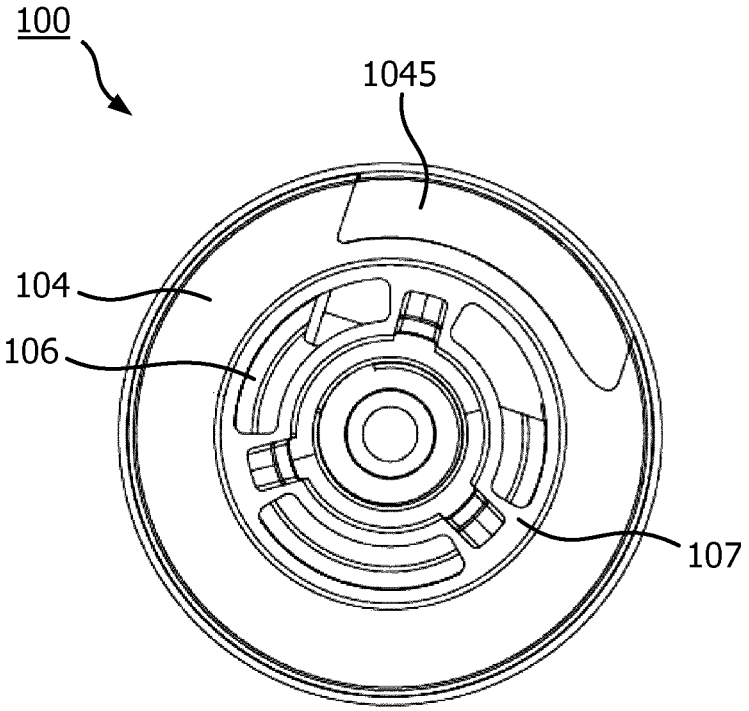
FIG. 8 shows a perspective top view of the lighting device illustrated in FIG. 3.

As shown in FIG. 6, an air chamber 1051 is formed between the cover 103 and the heat sink component 104. As shown in FIG. 5, openings 102 are provided in a rim 1033 around the recess 1031 of the cover 103, thereby creating a first connection between the air chamber 1051 and ambient air. As shown in FIG. 6 and FIG. 8, openings 106 are provided in the bottom 1043 of the heat sink component 104 adjacent to the sidewall 1044, thereby creating a second connection between the air chamber 1051 and ambient air. Openings 102 and 106, together with the air chamber 1051, form a channel allowing air to flow through the air chamber 1051, as indicated by means of the dash-lined arrow 105. Further, a further channel is formed between the first holes 1071 and the second holes 1042 to allow a further flow of air between the first and the second holes, as indicated by means of the dash-lined arrow 1055.

A driver assembly 108, which includes driver electronics on a PCB, is arranged in the air chamber 1051. The distance d between the further flow of air 1055 and an optical axis 120 of the lamp 100 is less than the distance D between the optical axis 120 and a component of the driver electronics having the highest temperature sensitivity, for example, an electrolytic capacitor.

When the lamp 100 is operated vertically as illustrated in FIG. 6, being for instance a down-lighting, a chimney effect will be created in the heat sink structure. The heat source, i.e. the light source 101, pre-heats the airflow and creates a buoyancy force. The higher the temperature of the air, the larger the driving force will be. This driving force is created by the density difference between hot air and the relatively cold ambient air. In a gravitational field, the hot air becomes less dense and rises, driven by the buoyancy force. Meanwhile, the cold air follows, taking up the space left by hot air, thus creating the airflow. When the air passes through the channel, it has been and will be heated and thus stores a certain amount of energy. As long as the air leaves the channel or air chamber, the heat is carried away. The heat produced by LEDs is mainly removed through the moving air, including both internal (in the chimney channel or air chamber) and external moving air, i.e. outside the lighting device. The further channel between the first holes 1071 and the second holes 1042 helps to remove the heat which normally converged in the central part of a prior art lamp, thus allowing further improved thermal dissipation. The thermally sensitive driver electronics on the driver assembly 108 is arranged in the air chamber 1051, where cold air enters and causes the temperature around the driver assembly 108 to be lower than at the location of the upper portion of the lamp 100, which is heated by the rising hot air. As a result, these driver electronics receive minimum influence from the heat flow.

In this embodiment, the cross section of the channel between the inlet and the outlet, i.e. openings 102 and 106, is enlarged, so that the air velocity inside the air chamber 1051 is as low as possible and the overall flow losses in the system are minimized. This is advantageous because it decreases the thermal resistance.

As shown in FIG. 3, a compartment 1048 is provided to accommodate the driver assembly 108. The compartment 1048 is provided in the air chamber 1051 (see FIG. 6). The advantage of using the compartment 1048 instead of directly positioning the driver assembly 108 in the air chamber 1051 may be that the driver assembly 108 can be encased in the compartment 1048 by means of potting material to conduct heat from the driver electronics to the heat sink component. The potting material may be silicon oil, micro-silica powder or asphalt, or a mixture of such materials. By encasing the driver electronics in potting material, the driver electronics will be able to conduct heat more efficiently to the heat sink component, whereby the driver electronics may produce more power, or the driver electronics may be manufactured by other, less costly, materials, materials having a smaller environmental impact or materials producing more heat at the same power. Further, in the manufacturing process of the lamp 100, it may be easier to insulate the driver assembly 108 in the compartment 1048 so as to prevent the safety issue of electric shock.

In the embodiment shown in FIGS. 3 to 8, an outer surface 1045 of the compartment 1048 acts as a patch to the sidewall 1044 of the heat sink component 104. Although the sidewall 1044 is no longer a perfectly intact, smooth, exposed surface, such a sacrifice in ornamental appearance may be acceptable to a certain extent, because it may simplify the assembly procedure of the lamp 100.

Figure 9:
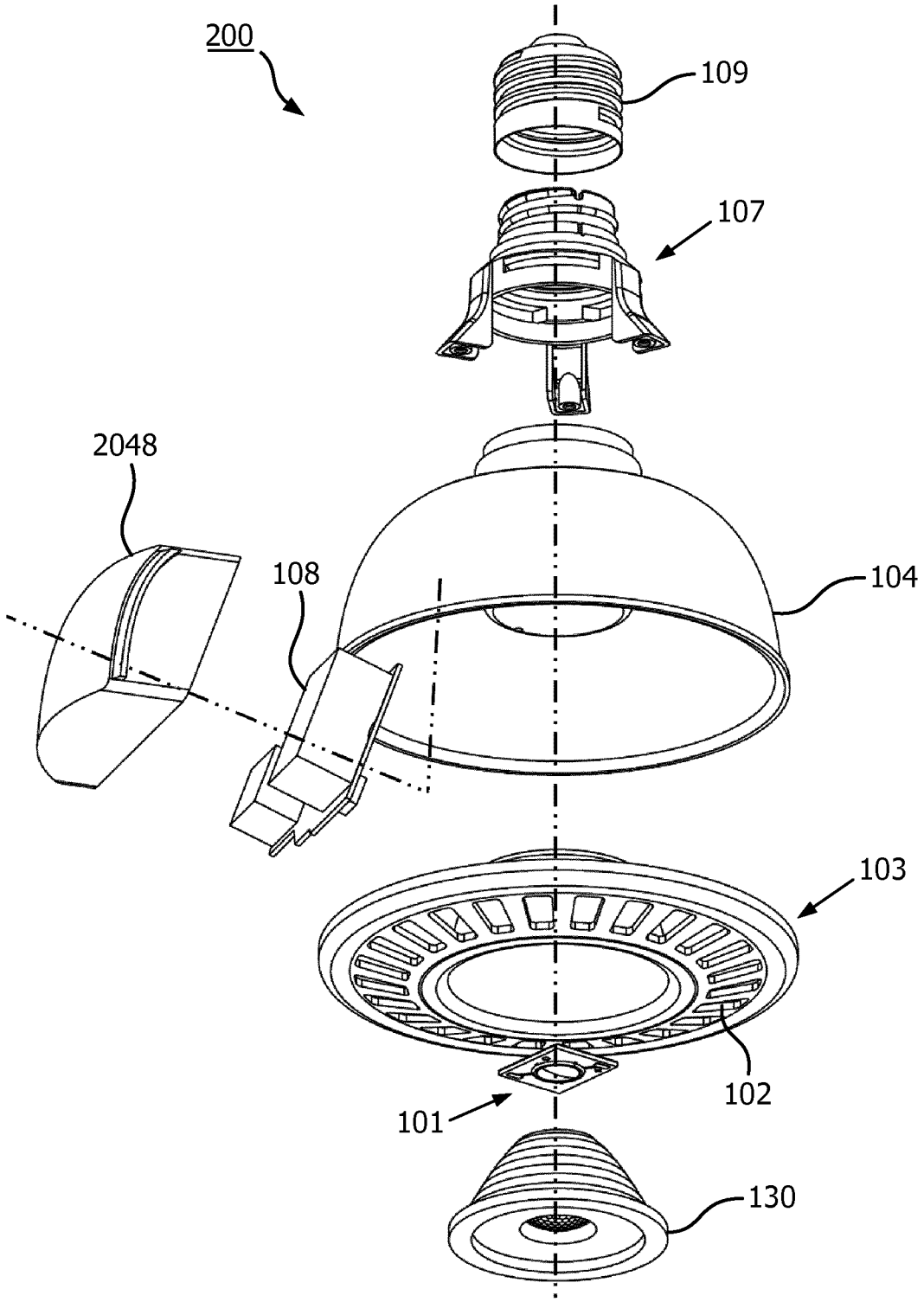
FIG. 9 shows an exploded view of a lighting device according to another embodiment of the invention.
Figure 10:
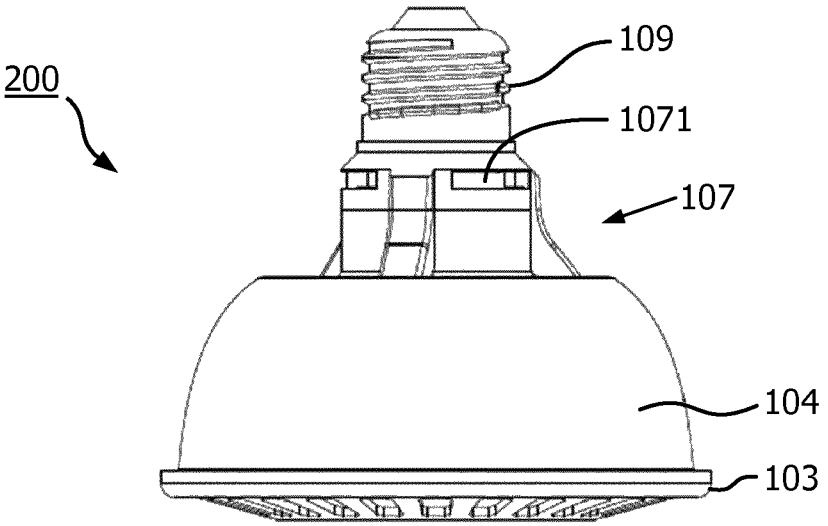
FIG. 10 shows a perspective side view of the lighting device illustrated in FIG. 9.

Alternatively, in the embodiment of lamp 200 shown in FIG. 9, a compartment 2048 is mounted completely within the heat sink component 104. The driver assembly 108 may be encased in the compartment 2048 by means of potting material in the same manner as in the previous embodiment. As shown in FIG. 10, which is an outside view of the lamp 200, the sidewall 1044 of the heat sink component 104 is an intact, smooth, exposed surface, without holes, slots or fins, which provides an ornamental effect.

In an alternative embodiment, the compartment 1048 or 2048 is not used. In other words, the driver assembly 108 is mounted directly on the heat sink component 104, and within the air chamber 1051.

Figure 11:
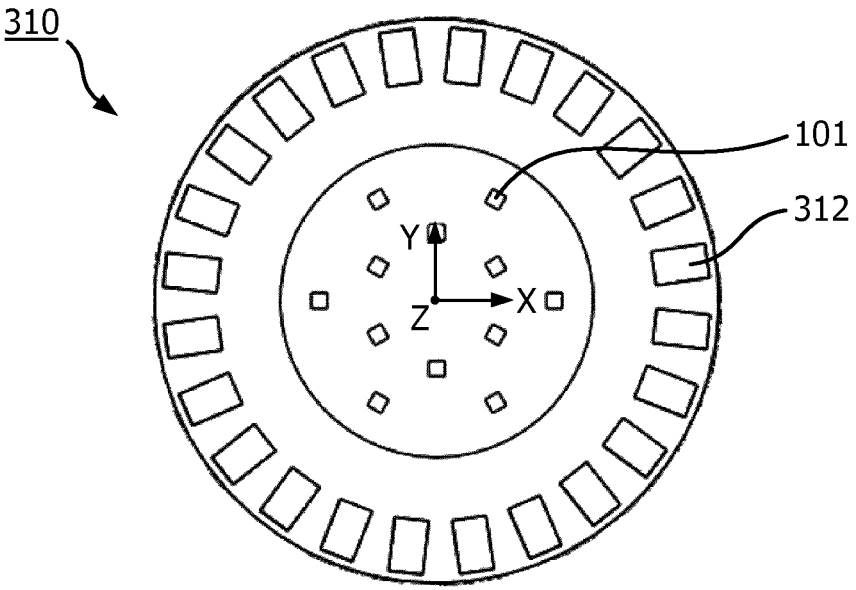
FIG. 11 shows the PCB of the lighting device according to a further embodiment of the invention.

In a further embodiment of the invention, the light source 101 is mounted on a large Printed Circuit Board (PCB) 310 as shown in FIG. 11, instead of the PCB 110 as shown in FIG. 3 of the first embodiment. The PCB 310 extends into the air chamber 1051 like in previous embodiments, and the PCB has a plurality of PCB openings 312 to allow the airflow to pass smoothly through the air channel like in previous embodiments. The PCB openings may be configured as cut-outs at the edge of the PCB or holes 312 as shown in FIG. 11. Preferably, the holes 312 are aligned with the openings 102 in the cover 103 so as to allow maximum airflow.

The PCB 310 comprises a thermally conductive material, for example, a thick layer of copper, so that thermal conductivity of the PCB is at least 28 W/mK measuring along surface of the PCB. In this embodiment, the PCB 310 acts as a heat sink which can bring additional thermal performance to the lamp or provide solutions with lower cost, for instance a whole plastic lamp. In such whole plastic lamp, low cost engineering plastic is used for the cover 103, the heat sink component 104 and the housing 107.

A person skilled in the art can understand that other types of back-reflecting lamp bulbs, such as GU, MR, etc., can adopt the same principle to achieve a lamp with a smooth appearance and the advantages of low cost, good manufacturability and high heat dissipation capability.

A person skilled in the art can understand that a luminaire can be configured to fit a lighting device or lamp 100, 200 according to the above mentioned embodiments.

A person skilled in the art realizes that the present invention by no means is limited to the preferred embodiments described above. On the contrary, many modifications and variations are possible within the scope of the appended claims. It should be noted that the above-mentioned embodiments illustrate rather than limit the invention and that those skilled in the art will be able to design alternative embodiments without departing from the scope of the appended claims. In the claims, any reference signs placed between parentheses shall not be construed as limiting the claim. The word "comprising" does not exclude the presence of elements or steps not listed in a claim. The word "a" or "an" preceding an element does not exclude the presence of a plurality of such elements. The usage of the words first, second and third, etc., does not indicate any ordering. These words are to be interpreted as names. No specific sequence of acts is intended to be required unless specifically indicated.

The invention claimed is:

1. A lighting device comprising:

at least one light source;

a driver assembly, said driver assembly comprising driver electronics; and a heat sink component having a bottom and a sidewall extending from the bottom;

wherein during operation of the light source, a distance between an optical axis of the lighting device and a heat flow of the lighting device is less than a distance between the optical axis and a component of the driver electronics having the highest temperature sensitivity; and wherein the sidewall comprises a patch corresponding to a mounting position of the driver assembly.

2. The lighting device according to claim 1, wherein the heat sink component further has a concave part extending from the bottom into the heat sink component, and wherein the at least one light source thermally contacts the concave part; wherein the heat sink component comprises a heat sink opening, and the heat sink opening comprises a plurality of holes in the bottom of the heat sink component between the concave part and the sidewall; and a cover provided on the sidewall and opposite to the bottom thereby defining an air chamber between the cover, the sidewall, the bottom and the concave part; wherein the cover comprises a cover opening, and the air chamber forms a channel between the cover opening and the heat sink opening to allow a flow of air between the cover opening and the heat sink opening or vice versa;

wherein the driver assembly is arranged in the air chamber.

3. The lighting device according to claim 2, further comprising a housing having a plurality of first holes;

wherein the concave part has a side surface and a top surface, and wherein the side surface of the concave part forms a portion of the air chamber; wherein a plurality of second holes is formed in the side surface to communicate with the plurality of first holes; and wherein a further channel is formed between the first holes and the second holes to allow a further flow of air between the first and the second holes, or vice versa, during operation of the light source; the distance between an optical axis of the lighting device and the further flow of air is less than the distance between the optical axis and the driver assembly.

4. The lighting device according to claim 2, wherein the driver assembly is arranged in a compartment within the air chamber.

5. The lighting device according to claim 2, wherein the cover comprises a rim at its outer periphery, and the cover opening comprises a plurality of holes in the rim.

6. The lighting device according to claim 2, wherein the cover is of a thermally conductive material which thermally contacts the sidewall of the heat sink component.

7. The lighting device according to claim 2, wherein the cover comprises a recess which accommodates the at least one light source, and the recess thermally contacts the concave part.

8. The lighting device according to claim 7, wherein the recess further comprises at least one optical element for the at least one light source.

9. The lighting device according to claim 8, wherein the at least one optical element is selected from a group comprising a diffuser, a reflector, a lens, a collimator or a combination thereof.

10. The lighting device according to claim 2, wherein a cross section of the channel is larger than at least one of the cover opening and the heat sink opening.

11. The lighting device according to claim 2, wherein the at least one light source is thermally coupled to a PCB, which PCB extends into the air chamber, and which PCB has a plurality of PCB openings to allow the flow of air between the cover opening and the heat sink opening or vice versa.

12. The lighting device according to claim 11, wherein the PCB comprises a thermally conductive material, so that the thermal conductivity of the PCB is at least 28 W/mK measured along the surface of the PCB.

13. A luminaire comprising a lighting device according to claim 1.

* * * * *